United States Patent [19]

Fuchs

[11] 4,157,367

[45] Jun. 5, 1979

[54] ATOMIZING DEVICE FOR CARBURETORS

[75] Inventor: Gyula S. Fuchs, Cleveland, Ohio

[73] Assignee: Lou Nagy, Fairview Park, Ohio

[21] Appl. No.: 874,882

[22] Filed: Feb. 3, 1978

[51] Int. Cl.[2] ..... F02M 7/02

[52] U.S. Cl. ..... 261/121 A; 261/DIG. 38; 261/123; 261/124

[58] Field of Search ..... 261/DIG. 38, 121 A, 261/121 B, 123, 124

[56] References Cited

U.S. PATENT DOCUMENTS

| | | | |
|---|---|---|---|
| 1,466,557 | 8/1923 | Janney | 261/121 A |
| 2,093,011 | 9/1937 | Grosz | 261/121 A |
| 2,964,303 | 12/1960 | Smith et al. | 261/51 |
| 2,970,822 | 2/1961 | Ernest | 261/DIG. 38 |
| 3,330,543 | 7/1967 | Mennesson | 261/DIG. 38 |
| 3,485,482 | 12/1969 | Fuchs | 261/23 A |
| 4,075,296 | 2/1978 | Orsini et al. | 261/DIG. 38 |

FOREIGN PATENT DOCUMENTS

| | | | |
|---|---|---|---|
| 2233500 | 1/1975 | France | 261/DIG. 38 |

*Primary Examiner*—Tim R. Miles

*Attorney, Agent, or Firm*—Meyer, Tilberry & Body

[57] ABSTRACT

A carburetor for an internal combustion engine using gasoline fuel is provided with a metering rod for controlling the flow of gasoline through a metering orifice between a gasoline reservoir in the carburetor and the passage leading to the air intake bore of the carburetor. The metering rod is provided with an air passageway for atomizing fuel before delivery thereof to the air intake bore, and the improvement of the present invention provides for the outlet end of the atomizing air passageway to be disposed on the upstream side of the metering orifice with respect to the direction of fuel flow therethrough from the reservoir.

11 Claims, 5 Drawing Figures

ATOMIZING DEVICE FOR CARBURETORS

This invention relates to the art of carburetors for internal combustion engines and, more particularly, to an improved arrangement for pre-atomization of gasoline flowing from a reservoir in the carburetor to the engine manifold.

The present invention is an improvement over the pre-atomizing arrangement disclosed in my U.S. Pat. No. 3,485,482 issued Dec. 23, 1969, and the disclosure of which is incorporated herein by reference. In my earlier patent, a vertically reciprocable metering rod is operable to control the flow of fuel from a reservior in a carburetor through a metering orifice opening from the reservoir to a passage leading to the air intake bore of the carburetor which opens into the engine manifold. The metering rod has a tip end adapted to engage the metering orifice and is provided with an air passageway extending axially through the rod from the tip end to a location above the level of fuel in the reservoir. The outlet end of this passageway is at all times disposed on the downstream side of the metering orifice and, in response to suction created by engine operation, air is drawn through the passageway to mix with and atomize fuel flowing through the orifice from the reservoir. The purpose of the air passageway through the metering rod is to assure that gasoline drawn into the manifold of the engine is in a more finely divided state than is achieved without such pre-atomization.

While the pre-atomizing arrangement disclosed in my earlier patent serves its intended purpose quite well, I have discovered that improved pre-atomization and the improved benefits can be obtained by directing the atomizing air into contact with the fuel as the fuel flows toward the inlet side of the orifice from the reservoir. In this respect, the movement of fuel in the reservoir toward the inlet side of the metering orifice has a degree of turbulence which enhances mixing air with the gasoline and atomizing the gasoline substantially concurrently with flow thereof through the orifice. More particularly in this respect, the air is mixed with the fuel and/or initiates atomization thereof prior to the fuel being further broken up and dispersed by its flow across the metering orifice. In contrast to this, when the fuel first flows across the orifice and is then subjected to the impingement of air flowing through the metering rod, as in my earlier arrangement, a lesser degree of mixing and/or atomizing is achieved than is desirable, whereby an undesirable amount of raw gas and/or gasoline with insufficient air is carried to the engine manifold. This is partly because the velocities of the gasoline and air downstream of the orifice are about the same reducing the ability of the air to break up the liquid particles flowing through the metering orifice.

In accordance with one aspect of the present invention, atomization is improved by the impingement of air on the gasoline upstream of the metering orifice and thus prior to the increase in velocity of the gasoline which results from flow thereof through the orifice. In accordance with another aspect of the present invention, atomization and/or mixture of the air with the gasoline is further improved by directing the air toward a surface in the carburetor surrounding the metering orifice on the upstream side thereof. This provides for the air to cause the gasoline to impinge on the surface and thus be broken up by the forces of such impingement. Accordingly, a more efficient and complete breaking up of gasoline and/or mixture of air therewith is achieved by the improvement of the present invention. This enables improved fuel combustion and improved performance of the vehicle with better power and mileage and, at the same time, more perfect combustion and thus a decrease in air pollution.

It is accordingly an outstanding object of the present invention to provide an improved arrangement for pre-atomizing gasoline flowing through a metering orifice in a carburetor of an internal combustion engine toward the air intake bore of the carburetor leading to the engine manifold.

Another object is the provision of an improved pre-atomizing arrangement which provides for atomizing the gasoline prior to passage thereof through the metering orifice.

Yet another object is the provision of a pre-atomizing arrangement of the foregoing character which enables improved fuel combustion and improved efficiency of engine performance and a decrease in air pollution by exhaust gases from the engine.

The foregoing objects, and others, will in part be obvious and in part pointed out more fully hereinafter in conjunction with the written description of the preferred embodiment of the invention shown in the accompanying drawings in which.

Figure 1:
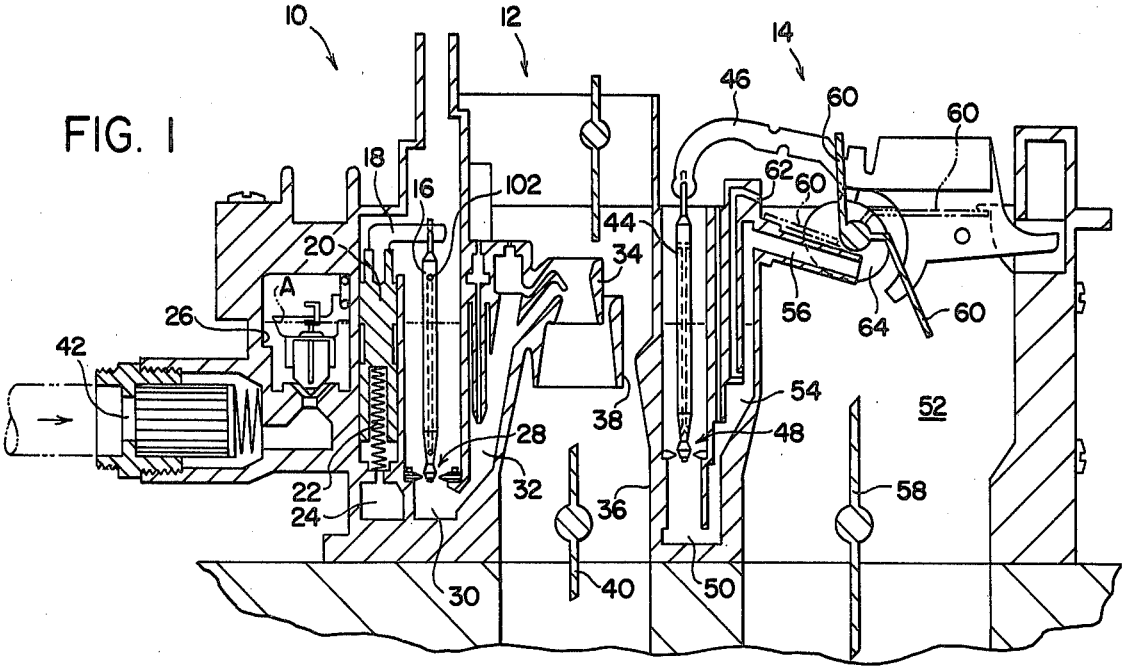
FIG. 1 is a sectional elevation view through a four barrel carburetor and illustrating the improvement of the present invention in connection therewith.

Referring now in greater detail to the drawings wherein the showings are for the purpose of illustrating preferred embodiments of the invention only and not for the purpose of limiting the invention, FIG. 1 illustrates a four barrel carburetor 10 for an internal combustion engine, and which carburetor has a primary side 12 and a secondary side 14 as set forth more fully hereinafter. A carburetor of the type illustrated would use four metering rods, but it will be appreciated that the present invention is applicable to any internal combustion engine carburetor utilizing one or more metering rods.

Primary side 12 of carburetor 10 includes a pair of primary metering rods 16 having upper ends pivotally interconnected with a support arm 18. It will be appreciated that the second metering rod 16 is disposed behind the one visible in FIG. 1 in side-by-side relationship therewith. In the embodiment illustrated, support arm 18 is vertically displaceable by means of a piston 20 to which the support arm is attached. The position of piston 20 depends upon the interplay between a compression spring 22 therebeneath and the vacuum in chamber 24 which is connected with the engine manifold. High vacuum will hold piston 20 and thus support arm 18 down, and low vacuum will permit the piston and thus the support arm 18 to move upwardly, as is well known in the art. Carburetor 10 includes a gasoline reservoir or bowl 26 having a maximum level of gasoline therein as represented by broken line A, and metering rod 16 is suspended in the reservoir of gasoline. The bottom of the reservoir is provided with a metering orifice 28 for each rod 16 and orifice 28 communicates the reservoir with a fuel well 30. As set forth more fully hereinafter, the lower or tip end of metering rod 16 cooperates with orifice 28 to meter the discharge of gasoline from reservoir 26 to fuel well 30. Fuel well 30 is in communication with a passageway 32 leading to a venturi 34 in the air intake bore 36 of the carburetor. As is well known, venturi 34 is associated with a larger venturi 38 in the air intake bore and both of which venturies are upstream from throttle valve 40 in the air intake bore which of course leads to the engine manifold. Gasoline is supplied in a well known manner to the carburetor through an inlet 42.

When the engine speed is increased to a point where the primary side of the carburetor cannot supply air and fuel requirements, secondary side 14 of the carburetor becomes effective. Secondary side 14 includes a pair of metering rods 44 disposed side-by-side in a manner similar to rod 16, whereby only one of the rods 44 is visible in FIG. 1. The upper ends of rods 44 are pivotally suspended from an actuator arm 46 disposed above the level A of gasoline in the carburetor reservoir, and each of the rods has a lower or tip end associated with a corresponding metering orifice 48 in the bottom of the reservoir. Orifice 48 communicates the gasoline reservoir with a secondary gasoline well 50 therebeneath, and metering rod 44 controls the flow of gasoline from the reservoir to the secondary fuel well. Secondary well 50 is in communication with the carburetor secondary air inlet bore 52 by means of a passageway 54 and tube 56, and the gasoline and air mixture flowing through passageway 54 and tube 56 flows to bore 52 under the control of secondary throttle valve 58. The secondary throttle valve is of course actuated by connecting linkage to the primary throttle valve. When the throttle valve 58 is open, a vacuum is created beneath the air valve 60 which is spring loaded to the broken line position shown in FIG. 1. Atmospheric pressure on top of valve 60 forces the valve to the open position shown in full line in FIG. 1 allowing the required air to flow through the air inlet bore to meet the engine demands. As air valve 60 opens, the upper edge thereof passes the accelerating well port 62 causing a vacuum at that point. Moreover, as air valve 60 opens it rotates cam 64 which is attached to the main air valve shaft, and cam 64 lifts actuator arm 46 to raise metering rods 44 relative to their corresponding orifice 48.

In accordance with the present invention, metering rods 16 and 44 are operable to pre-atomize the gasoline upstream of the corresponding one of the orifices 28 and 48. The manner in which such pre-atomization is achieved will be best understood with reference to the detailed illustrations of metering rods and orifices shown in FIGS. 2–4 of the drawing. With regard first to FIGS. 2 and 3, primary side metering rod 16 has a lower or tip end 66 and an upper end 68 provided with a stem 70 by which the rod is suspended from support arm 18. Tip end 66 as described hereinabove is associated with metering orifice 28 between gasoline reservoir 26 and fuel well 30 and, in the embodiment shown, orifice 28 is defined by an annular orifice plate 72 captured between mounting plates 74 and 76 attached to an annular shoulder of the carburetor by means of threaded fasteners 78. Plates 72, 74 and 76 are tapered peripherally of the openings therethrough to provide the orifice with a knife-edge orifice opening 80 peripherally bounded on its upper and lower sides by frusto-conical surfaces 82 and 84, respectively. It will be appreciated that with respect to the direction of flow of fuel from reservoir 26 to well 30, surface 82 is on the upstream side of the orifice and surface 84 is on the downstream side thereof.

Figure 2:
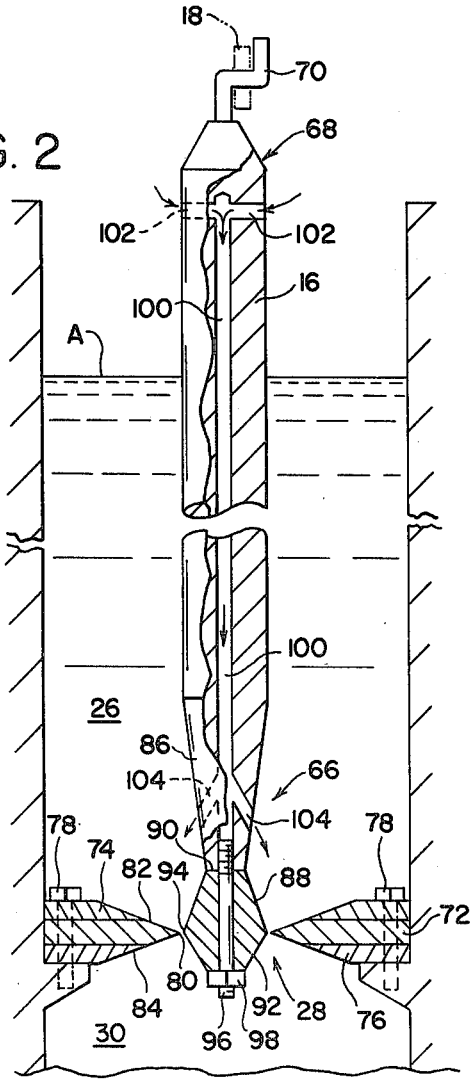
FIG. 2 is a sectional elevation view of an improved metering rod in the primary side of the carburetor constructed in accordance with the present invention.
Figure 3:
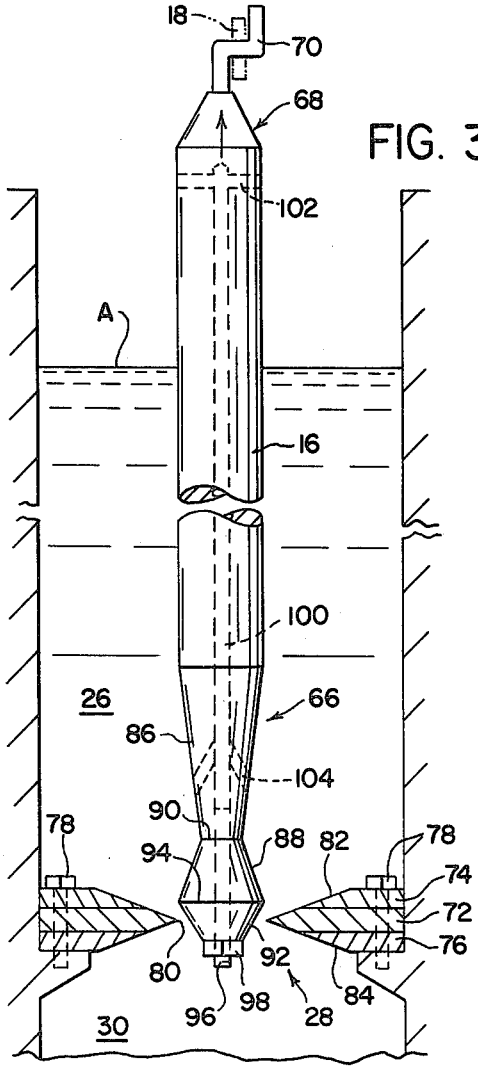
FIG. 3 is a sectional elevation view similar to FIG. 2, showing the metering rod in its open position with respect to the orifice, and illustrating a modification of the metering orifice structure.

Tip end 66 of metering rod 16 is contoured to provide axially opposed first and second frusto-conical outer surface portions 86 and 88, respectively, disposed on the upstream side of the orifice. Surfaces 86 and 88 converge toward one another and meet along a peripheral line of juncture 90. Tip end 66 further includes a third frusto-conical outer surface portion 92 which converges in the downstream direction from second surface portion 88 and which has a peripheral line of juncture 94 with surface 88. Junction line 94 is coplanar with orifice edge 80 when the metering valve is in its closed position with respect to the orifice as shown in FIG. 2. Tip end 66 can be constructued in any desired manner and, in the embodiment shown, surfaces 88 and 92 are defined by an apertured component mounted on the body of the rod by means of a threaded rod 96 received in the end of the rod body and a retaining nut or the like 98 screwed onto rod 96.

Metering rod 16 is provided with an axially extending passageway 100 having an inlet end at upper end 68 of the rod. The inlet end of the passageway is defined by transverse passageways 102 which communicate with fuel reservoir 26 at a location therein above the maximum level A of fuel in the reservoir. Passageway 100 has an outlet end in tip end 66 of the rod at a location upstream of orifice 28. More particularly, the outlet end of passageway 100 is defined by passageways 104 opening through first frusto-conical surface portion 86 and having axes extending downwardly and outwardly toward upper surface 82 of the orifice plate assembly.

Figure 4:
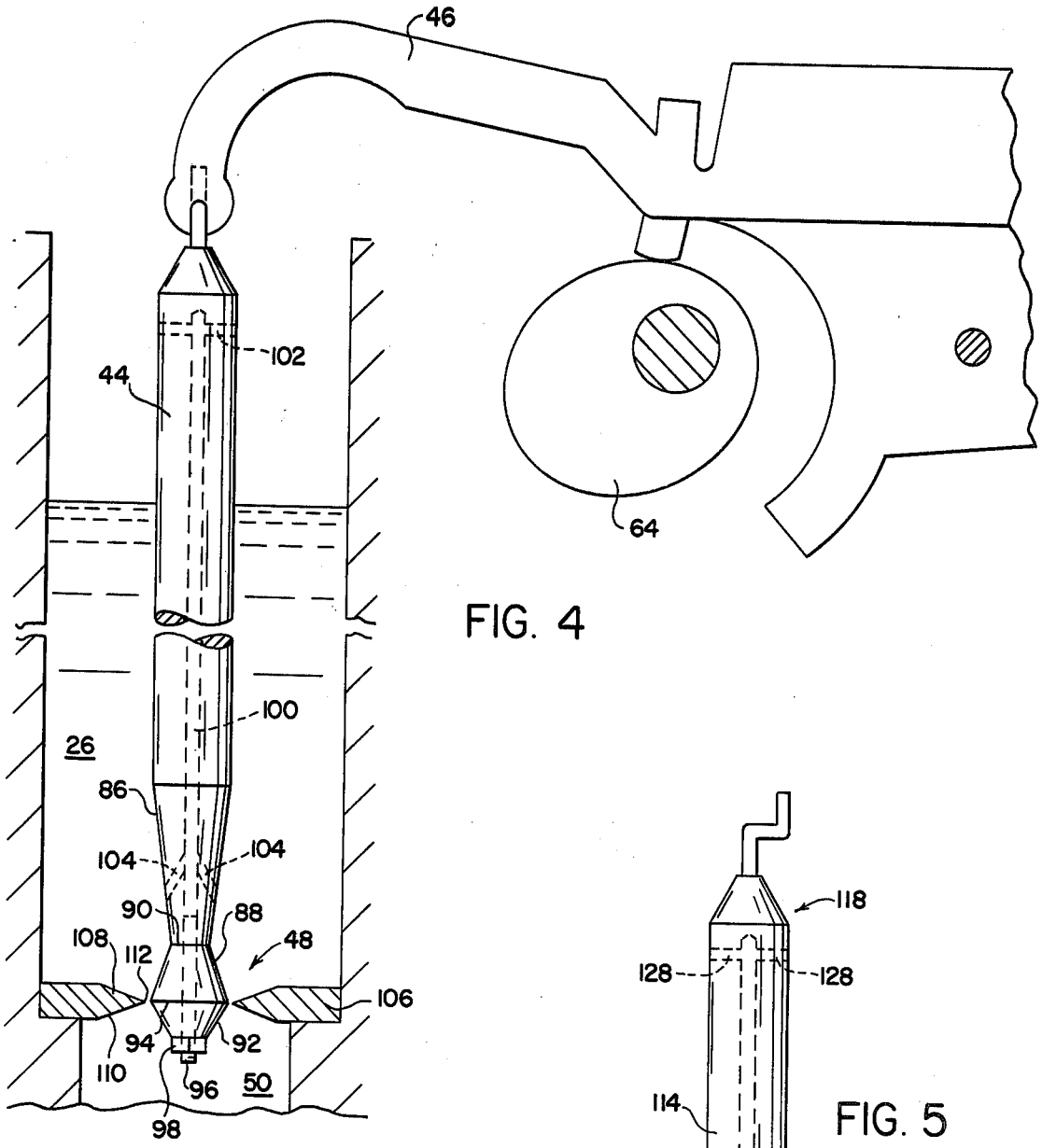
FIG. 4 is an elevation view, partially in section, showing a metering rod in accordance with the present invention in association with the metering orifice in the secondary side of the carburetor shown in FIG. 1; and, FIG. 5 is a sectional elevation view of another embodiment of a metering rod in accordance with the present invention.

Secondary metering rod 44 in the embodiment shown in FIG. 4 is basically of the same structure as that of metering rod 16 described hereinabove and, accordingly, like numerals are employed in FIG. 4 to designate the corresponding surface portions and passageway portions of metering rod 44. In the embodiment shown, the secondary metering orifice 48 is defined by a unitary annular orifice plate 106 press fitted or otherwise suitably retained in place with respect to the carburetor. Orifice plate 106 in a manner similar to that of the orifice assembly described above is provided with frusto-conical upper and lower surfaces 108 and 110, respectively, peripherally bounding the orifice opening and converging to provide an annular knife-edge orifice opening 112.

During operation of the internal combustion engine, a negative pressure is created in fuel wells 30 and 50. Edge 94 at the tip end of primary metering rod 16 is normally positioned upwardly from orifice edge 80 during engine operation, whereby the vacuum in fuel well 30 causes air to be drawn into air passageway 100 through inlet passages 102 above the level of fuel in reservoir 26. The air thus drawn into passageway 100 is discharged through outlet passages 104 directly into the fuel and toward orifice plate surface 82 to mix with and atomize the fuel as the latter is moving toward and through the orifice opening. The configuration of the tip end of the metering rod as defined by frusto-conical surfaces 86, 88 and 92 enhances the mixing and atomizing operation. In this respect, surfaces 86 and 88 divert fuel flowing along the tip end of the metering rod toward orifice plate surface 82 and this creates a certain amount of turbulence which supplements the breaking up of fuel caused by the flow of air into the fuel and the impingement of fuel against orifice surface 82 by such air flow. When the engine speed is increased to the point where the primary side of the carburetor cannot supply sufficient air and fuel requirements, the secondary side of the carburetor comes into play, as described hereinabove. Accordingly, at such time a similar preatomization of fuel is achieved by the contour of the tip end of secondary metering rod 44 and the flow of air into the fuel and toward orifice plate surface 108 on the upstream side of orifice plate 106.

Figure 5:
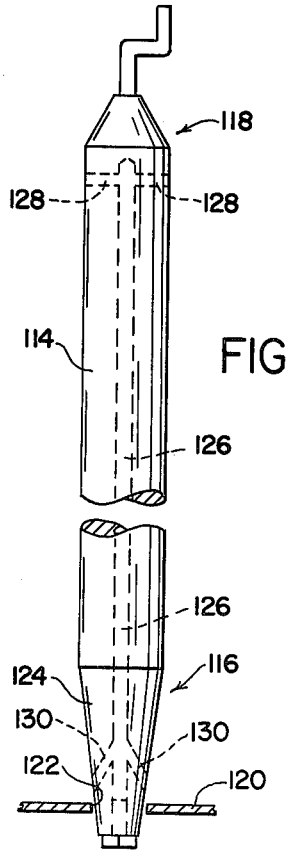

FIG. 5 illustrates another embodiment of a metering rod in accordance with the present invention and which can be employed as the primary and/or secondary metering rod. With regard to FIG. 5, metering rod 114 has a tip end 116 and an upper end 118. Tip end 116 is shown associated with an annular orifice plate 120 suitably supported in a carburetor between a fuel reservoir and fuel well as in the embodiments described hereinabove. In the embodiment of FIG. 5, orifice plate 120 has a frusto-conical opening 122 therethrough for engagement with frusto-conical surface portion 124 on tip end 116 of the metering rod. As in the embodiment of FIGS. 2–4, metering rod 114 has an axially extending air passageway 126 therein having an inlet end defined by transverse passages 128. Further, passageway 126 has an outlet end defined by passages 130 opening through frusto-conical surface 124 of the metering rod and extending outwardly and downwardly toward the upper surface of orifice plate 120. Accordingly, it will be appreciated that air flows through passageway 126 from inlet passages 128 and thence through outlet passages 130 to mix with and atomize fuel on the upstream side of the metering orifice and as the fuel in the reservoir flows toward and through the orifice.

While considerable emphasis has been placed herein on the preferred embodiments illustrated and described, it will be appreciated that many changes can be made therein without departing from the principles of the present invention. Accordingly, it is to be distinctly understood that the foregoing descriptive matter is to be interpreted merely as illustrative of the present invention and not as a limitation.

Having thus described the invention it is claimed:

1. In a carburetor for an internal combustion engine having an air bore opening to the manifold of said engine and subject to suction when said engine is operating, a fuel well and a passage connecting said well to said air bore, a fuel supply reservoir above said well, a metering orifice communicating said reservoir and well, a vertically displaceable metering rod coaxial with said orifice and having an axially extending tip and portion including means coacting with said orifice to vary the flow of fuel therethrough, means to displace said metering rod relative to said orifice in response to operation of said internal combustion engine, and air passageway means in said metering rod for directing air from an inlet above the level of fuel in said reservoir to an outlet in said tip end portion, the improvement comprising: said orifice having upstream and downstream sides with respect to the direction of flow of fuel from said reservoir to said well, and said air passageway outlet in said tip end portion of said metering rod opening laterally from said rod into said reservoir on the upstream side of said orifice.

2. The improvement according to claim 1, wherein said air passageway has an axis coaxial with said metering rod, and said outlet in said tip end portion diverges with respect to said axis.

3. The improvement according to claim 1, wherein said orifice is bounded on the upstream side thereof by a frusto-conical surface converging in said downstream direction, and said outlet in said tip end portion of said metering rod is directed toward said surface.

4. The improvement according to claim 1, wherein said tip end portion of said metering rod includes a frusto-conical outer surface portion converging in said downstream direction, said outlet at said tip end portion being through said outer surface portion.

5. The improvement according to claim 4, wherein said air passageway has an axis coaxial with said metering rod and said outlet at said tip end portion diverges with respect to said axis in the downstream direction.

6. The improvement according to claim 5, wherein said orifice is bounded on the upstream side thereof by a frusto-conical surface converging in said downstream direction, and said outlet at said tip end portion of said metering rod is directed toward said surface.

7. In a carburetor for an internal combustion engine having an air bore opening to the manifold of said engine and subject to suction when said engine is operating, a fuel well and a passage connecting said well to said air bore, a fuel supply reservoir above said well, a metering orifice communicating said reservor and well, a verticaly displaceable metering rod having an axially extending tip end portion including means coacting with said orifice to vary the flow of fuel therethrough, means to displace said metering rod relative to said orifice, and air passageway means in said metering rod for directing air from an inlet above the level of fuel in said reservoir to an outlet in said tip end portion, the improvement comprising: said orifice having upstream and downstream sides with respect to the direction of flow of fuel from said reservoir to said well, and said air passageway outlet at said tip end of said metering rod being located therein on the upstream side of said orifice, said tip end portion of said metering rod including axially opposed first and second frusto-conical outer surface portions on said upstream side of said orifice and converging toward one another.

8. The improvement according to claim 7, wherein said first and second frusto-conical surface portions are respectively upstream and downstream on said tip end portion with respect to one another, said outlet at said tip end portion being through said first outer surface portion.

9. The improvement according to claim 8, wherein said orifice is bounded on the upstream side thereof by a frusto-conical surface converging in said downstream direction, and said outlet at said tip end portion of said metering rod is directed toward said surface.

10. The improvement according to claim 8, wherein said tip end portion of said metering rod includes a third frusto-conical outer surface portion extending downstream from said second outer surface portion and converging in said downstream direction.

11. The improvement according to claim 10, wherein said orifice is bounded on the upstream side thereof by a frusto-conical surface converging in said downstream direction, and said outlet at said tip end portion of said metering rod is directed toward said surface.

* * * * *